US011180335B2

(12) United States Patent
De Gaillande et al.

(10) Patent No.: US 11,180,335 B2
(45) Date of Patent: Nov. 23, 2021

(54) DEVICE FOR UNWINDING STRIPS AND MACHINE FOR STAMPING ELEMENTS IN SHEET FORM

(71) Applicant: BOBST MEX SA, Mex (CH)

(72) Inventors: Christophe De Gaillande, Monts-de-Cors (CH); Bernard Jaquet, Rue (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 17/274,344

(22) PCT Filed: Sep. 6, 2019

(86) PCT No.: PCT/EP2019/025298
§ 371 (c)(1),
(2) Date: Mar. 8, 2021

(87) PCT Pub. No.: WO2020/052809
PCT Pub. Date: Mar. 19, 2020

(65) Prior Publication Data

US 2021/0245985 A1 Aug. 12, 2021

(30) Foreign Application Priority Data

Sep. 10, 2018 (EP) ..... 18020442

(51) Int. Cl.
*B65H 20/24* (2006.01)
*B65H 16/00* (2006.01)

(52) U.S. Cl.
CPC ..... *B65H 20/24* (2013.01); *B65H 16/00* (2013.01); *B65H 2301/4491* (2013.01); *B65H 2404/1521* (2013.01)

(58) Field of Classification Search
CPC ..... B65H 20/24; B65H 20/34; B65H 16/00; B65H 2301/4491; B65H 2404/1521
See application file for complete search history.

(56) References Cited

FOREIGN PATENT DOCUMENTS

| | | | |
|---|---|---|---|
| CH | 292425 | A | 8/1953 |
| EP | 0742170 | A2 | 11/1996 |

(Continued)

OTHER PUBLICATIONS

International Search Report dated Dec. 13, 2019, in counterpart International Patent Application No. PCT/EP2019/025298 (5 pages).

*Primary Examiner* — William E Dondero
(74) *Attorney, Agent, or Firm* — Bookoff McAndrews, PLLC

(57) ABSTRACT

The invention concerns a device for unrolling a strip (10) for a stamping machine (1) that allows an accumulation of the strip to be stamped (2) under a pre-unrolled form between at least one stamping spool (3) and a plate press (310) of the stamping machine (1), so characterized in that the device for unrolling a strip (10) comprises:

- a central drum (11) configured to be led in rotation at a variable advance speed, united in rotation with an axis of the device for unrolling the strip (10),
- a satellite roller (14) presenting an axis (11) constructed parallel to the axis of the central drum (11), where the satellite roller (14) can be turned around the central drum (11), and the pre-unrolled strip may be rolled around the central drum (11) due to the movement of the satellite roller (14), and
- a planetary leading device (15) to move the satellite roller (14) around the central drum (11) as a function of the difference of the rotation speeds of the central drum (11) and of an exterior ring (13) of the planetary leading device (15) configured to be led in rotation at a constant speed in the rotation direction contrary to the rotation direction of the central drum (11).

The invention also comprises a stamping machine (1) so configured as to place on each sheet the gilded or metallic film of at least one strip to be stamped (2).

17 Claims, 7 Drawing Sheets

(56) References Cited

FOREIGN PATENT DOCUMENTS

| | | | |
|---|---|---|---|
| JP | H09309645 | A | 12/1997 |
| WO | 2010063353 | A1 | 6/2010 |
| WO | 2012116781 | A | 9/2012 |

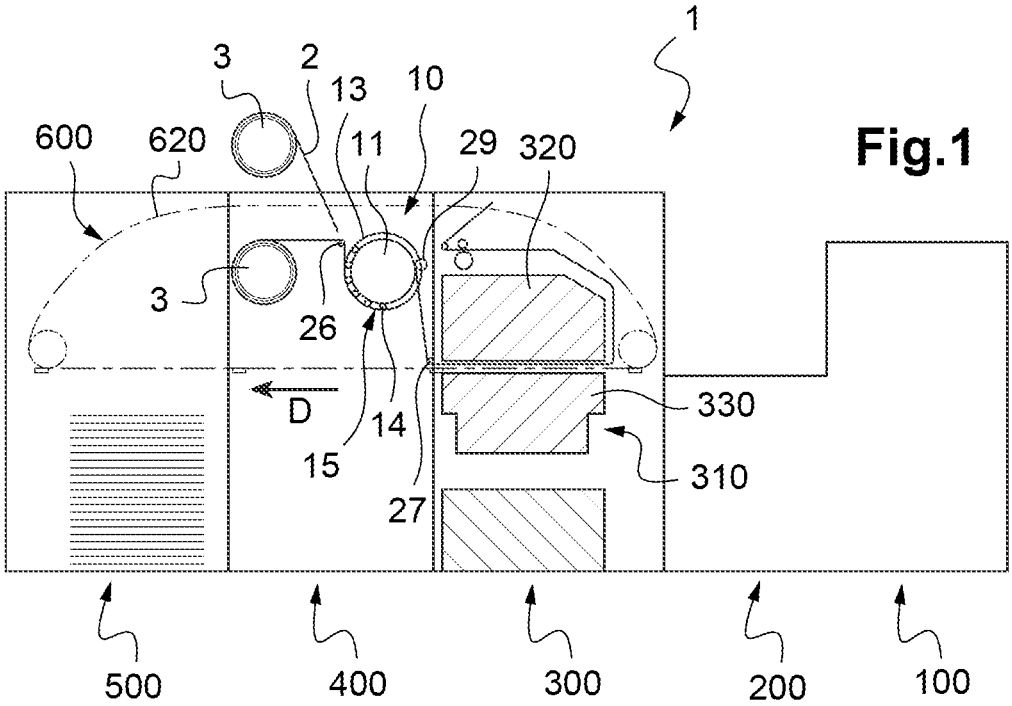
Fig.1
Fig.2
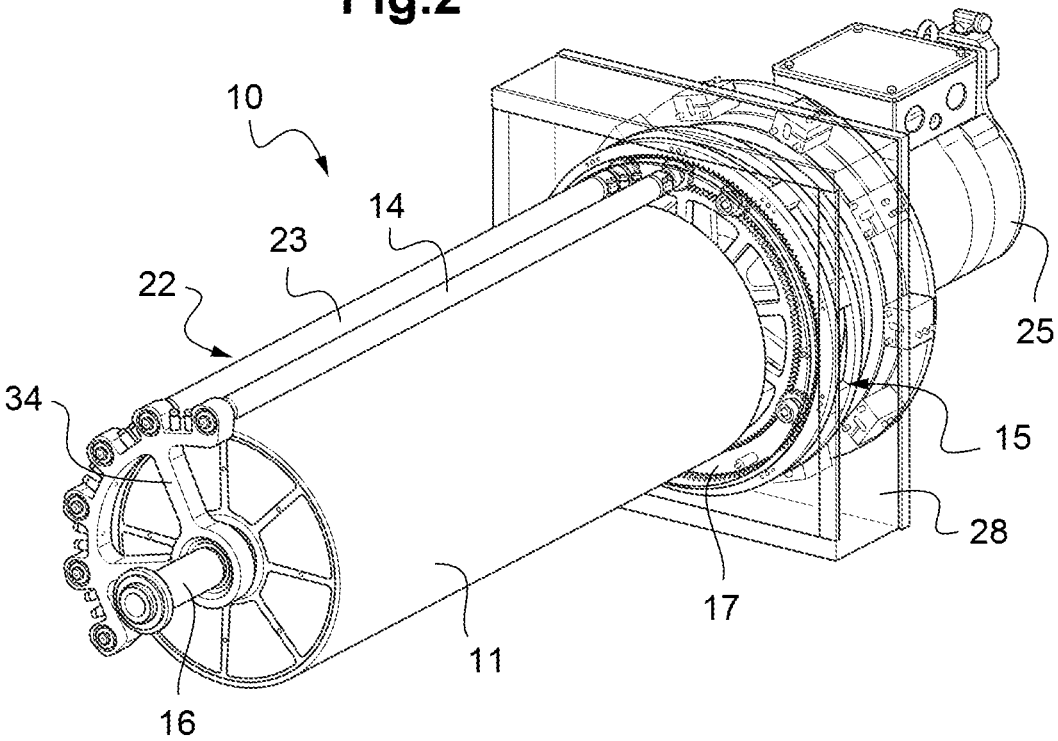

Coupe A-A

DEVICE FOR UNWINDING STRIPS AND MACHINE FOR STAMPING ELEMENTS IN SHEET FORM

CROSS-REFERENCE TO RELATED APPLICATION(S)

This application is a National Stage under 35 U.S.C. § 371 of International Application No. PCT/EP2019/025298, filed on Sep. 6, 2019, which claims priority to European Patent Application No. 18020442.2, filed on Sep. 10, 2018, the contents of all of which are incorporated by reference in their entirety.

This invention comprises a device for unrolling a strip for a machine for stamping elements into sheet form. The invention also comprises a stamping machine so configured as to place on each sheet the gilded or metallic film that is produced from at least one strip to be stamped.

It is known how to print texts and/or patterns by stamping, that is to say, by placing pressure on a support in the form of a sheet of the colored or metallic film produced by one or several strips to be stamped, together called metallic strips. In the industry, such an operation for transfer is traditionally done by means of a plate press in which the supports for the printing are introduced sheet by sheet, while each strip to be stamped is brought in in continuous fashion.

Each strip to be stamped is packaged in the form of a spool that is mounted in mobile fashion in rotation on the machine, and that is unwound through the use of an advancing shaft pulling directly on the strip. In practice, this advancing shaft is designed to turn out at variable speed, given that the advance of the strip operates in sequential fashion within the plate press. However, since a spool presents a heavy weight and thus relatively significant inertia, it turns out to be particularly difficult for it to follow such a succession of accelerations, decelerations, and pauses.

To remedy this difficulty, it is thought to disassociate the rotation of the spool from that of the advancing shaft, thus constituting a strip reserve between these two rotating organs. For this, one generally uses a system for unrolling the strip that is capable at the same time of accumulating the strip in pre-unrolled form downstream from the spool, and to deliver a proper length of pre-unrolled strip for each request from the advancing shaft. The presence of such a reserve of strip in an inserted position allows advantageously the unwinding of the spool at a roughly constant speed, all the while allowing the advancing shaft to function at a variable speed.

In this regard, a system is known from document WO2012/116781 for unrolling the strip that takes place between the spool and the advancing shaft, and which sets in motion two series of gears in which the distance can vary as a function of the advance of the strip. Concretely, the two series of gears are placed in such a way as to define a path for the circulation of the strip in which the form describes a succession of loops that bypass each gear respectively in passing alternatively from one series of gears to the other. One of the series of gears is mounted in mobile fashion in moving from one to the other between one position close together in which the series of gears are arranged one next to the other in a way to define a circulation path of the strip of minimal length, and a position at some distance in which the said series of gears are arranged at a distance in a way to define the circulation path of maximum length.

This system of unwinding the strip may however generate fits and starts due to the inertia of the spool, notably at the time of the transition phases of start-up and of stopping the acceleration and deceleration. These fits and starts may stretch the strip to be stamped and damage it. A spool braking device is generally necessary to guarantee the optimum tension of the band and not unwind the spool more than is necessary when the advancing shaft slows down and stops. Another drawback of the system is that it may turn out to be difficult to start in motion, in particular following some dysfunction of production. Another problem is also that the outsourced system requires a place on the ground and a deployment of the strip between the spool and the press, which are not negligible. This significant length of the unrolled strip may damage the precision of the removal and increase the length of the strip that is consumed.

One of the goals of this invention is to propose a device for unrolling a strip for stamping that allows the resolution at least partially of at least one of the drawbacks cited above.

To this end, this invention has as its object a device for unrolling a strip for a stamping machine that allows an accumulation of the strip to be stamped in a pre-unrolled form between at least one stamping spool and a plate press of the stamping machine, so characterized in that the device for unrolling a strip comprises:

a. a central drum configured to be moved in rotation at a variable advance speed, united in rotation with an axis of the device for unrolling a strip,
b. a satellite roller presenting an axis constructed parallel to the axis of the central drum, where the satellite roller can be turned around the central drum, and the pre-unrolled strip may be rolled around the central drum due to the movement of the satellite roller, and
c. a planetary leading device to move the satellite roller around the central drum as a function of the difference of the speeds of rotation of the central drum and of an exterior ring of the planetary leading device configured to be moved in rotation at a constant speed in the rotation direction contrary to the rotation direction of the central drum.

The strip to be stamped may thus be pre-unrolled at a constant speed of the stamping spool, drawn by the satellite roller. The strip may be delivered at the end of the device for unrolling a strip at a variable advance speed. The length of the strip to be stamped that is accumulated varies with the angular displacement of the satellite roller around the central drum, which, as a result of the planetary leading, varies as a function of the difference of the rotation speeds of the central drum and the exterior ring. It is thus possible to accumulate the strip to be stamped and then to deliver the accumulated strip to be stamped upon each request of the advancing shaft.

The device for unrolling a strip is more compact than a "linear" system of the previous state of the art because it can be integrated directly into the machine. It is also more robust and easier to set in motion. The distance between the spool and the press may be small, which permits an increase in the precision of the placement of the strip and thus allows a reduction in the amount of the strip that is consumed.

According to one embodiment, the planetary leading device comprises:

a. a central cogwheel united in rotation and coaxial to the central drum, while the exterior ring is coaxial to the central cogwheel,
b. a satellite door united with the movement of the satellite roller around the central drum and coaxial to the central drum, and
c. at least one satellite cogwheel mounted on the satellite door, engaging the exterior ring and the central cogwheel to be led in rotation in one direction or the other around the central drum as a function of the difference of rotation speeds of the central drum and the exterior ring.

According to one embodiment, the original radius of the central cogwheel corresponds to the exterior radius of the central drum.

According to one embodiment, the diameter of the satellite roller has a lower dimension than the radial space situated between the original diameter of the exterior strip and the exterior diameter of the central drum.

According to one embodiment, the satellite roller is rotary.

For example, the planetary leading device comprises in addition a toothed wheel mounted on the satellite door, united in movement with the satellite roller and engaging the exterior ring. For example, the original radius of the toothed wheel corresponds to the exterior radius of the satellite roller.

According to another embodiment, the satellite roller is fixed on a satellite door of the planetary leading device, and the satellite roller is porous, presenting an internal cavity configured to communicate with pressurized air so as to form a cushion of air under the strip to be stamped.

According to one embodiment, the planetary leading device comprises a guide united in moving the satellite roller around the central drum, with the guide being able to be interposed between two strands of the pre-unrolled strip in order to guide an exterior strand of the said strip.

According to one embodiment, the guide comprises between one and ten additional satellite roller or rollers, such as five, with the additional satellite roller or rollers and the satellite roller describing a circle.

The additional satellite roller or rollers may be rotating.

For example, the guide consists in addition of as many toothed wheels as there are additional satellite rollers, with the toothed wheels being mounted on the satellite door and united in rotation with a respective additional satellite roller and engaging the exterior ring.

According to another embodiment, the guide comprises a metallic element fixed to the satellite door, with the metallic element presenting between one and ten folds or curves, such as five folds or curves, with the fold or folds or curves or curves and the satellite roller describing a circle.

According to one embodiment, the diameter of the said circle corresponds to the original diameter of the exterior ring.

According to one embodiment, the exterior ring is configured to be led in rotation at a constant speed, roughly equal to the average value of the variable advance speed.

According to one embodiment, the axis of the central drum can be led in rotation at a variable advance speed by a motor of the device for unrolling a strip to form an advancing shaft. The number of parts can then be reduced.

The invention also has as an object a stamping machine for elements in the form of sheets configured in order to place, on each sheet, the gilded or metallic film created by at least one strip to be stamped, so characterized in that it comprises in addition at least one device for unrolling a strip such as described above.

SUMMARY DESCRIPTION OF THE DRAWINGS

Other advantages and characteristics will appear upon reading the description of the invention as well as on the attached figures that represent an example of a non-limiting embodiment of the invention and on which:

FIG. 1 illustrates very schematically an example of a stamping machine.

FIG. 2 shows a perspective view of a device for unrolling a strip of the stamping machine of FIG. 1 (with a transparent box represented)

Figure 3:
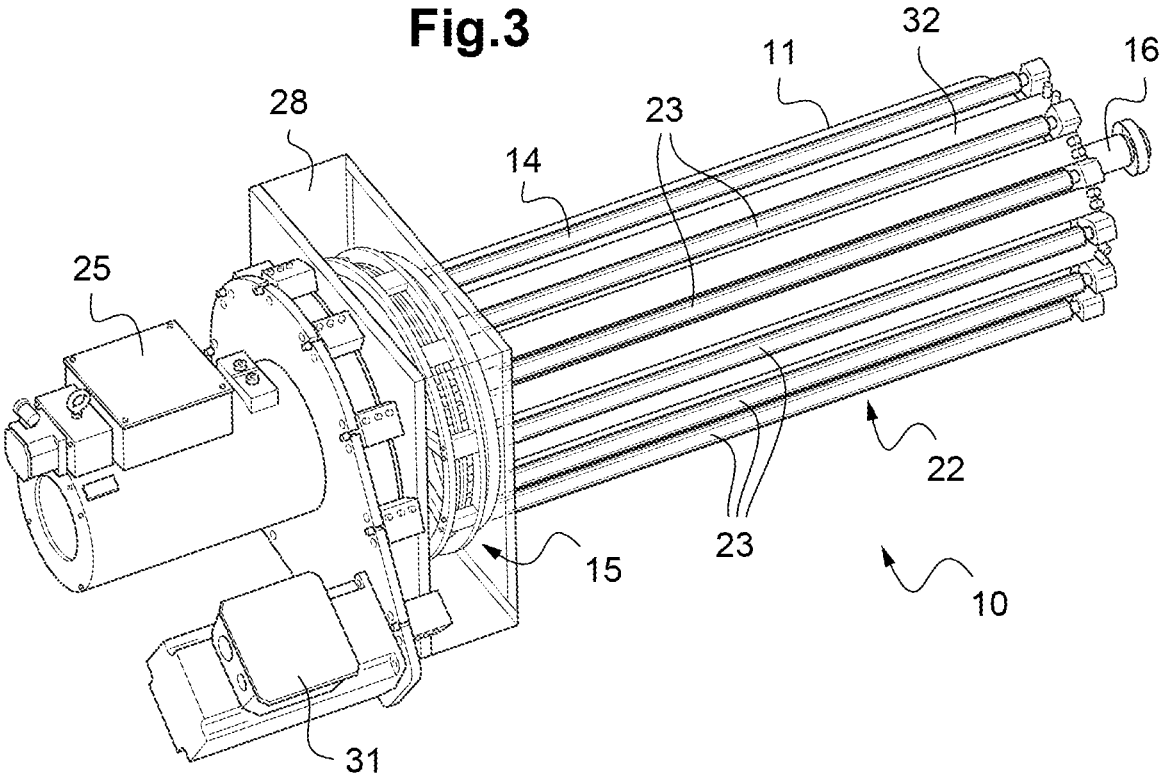
FIG. 3 shows another view of the device for unrolling a strip of FIG. 2.

On these figures, the identical elements carry the same reference numbers. The following embodiments are examples. Even though the description refers to one or several embodiments, this does not necessarily mean that each reference concerns the same embodiment, or that the characteristics apply only to a single embodiment. Simple characteristics of different embodiments may also be combined or interchanged in order to provide other embodiments.

The terms upstream and downstream are defined with reference to the longitudinal direction of movement of the sheets (FIG. 1). The sheets are placed from upstream to downstream, generally following the principal longitudinal axis of the machine in a movement whose rhythm is set by periodic stops.

The terms "elements in the form of sheets" and "sheets" will be considered as equivalent, and also comprise the elements made up of folded cardboard and of flat cardboard, of paper, or of any other material currently used in the packaging industry. It is intended that in the entire text, the terms "sheet" or "element in sheets" or "element in the form of sheets" designate in very general fashion any support for an impression in the form of sheets, such as cardboard sheets, paper sheets, plastic material sheets, etc.

The terms "above", "below", "low", "high", "horizontal", and "vertical" are defined in reference to the placement of the elements in a shaping machine set on the ground.

FIG. 1 represents an embodiment of a stamping machine 1 capable of setting, on each sheet, the gilded or metallic film what is produced by at least one stamping strip 2, in particular for the manufacture of packaging.

This machine 1 is classically composed of several workstations 100, 200, 300, 400, 500 that are juxtaposed but interdependent with one another to form a unified ensemble in order to treat a succession of elements in sheet form.

Thus, one finds a feeder 100, a margin stop 200, a stamping station 300, a strip feeding station 400, and a reception station 500. A transfer device 600 is also provided to individually move each sheet from the exit from the margin stop 200 up to the reception station 500, including across the stamping station 300.

In this particular embodiment, chosen only as an example, the sheets are successfully lifted from the top of a pile by a section grasping organ that transports them up to the margin stop 200 directly adjacent.

At the level of the margin stop 200, the sheets are put in a cloth by the suction grasping organ, that is to say, placed one after the other in a way that they partially overlap. The ensemble of the cloth is then led in movement along a plane in the direction of the stamping station 300 by means of a transport mechanism run by belts. At the end of the cloth, the head sheet may be systematically positioned precisely by the use of frontal and lateral wedges or by a register system.

The workstation situated just after the table stop 200 is thus the stamping station 300. This latter has a function of placing on each sheet by hot stamping the metallic film that is made by a stamping strip 2. For this, it uses a plate press 310 inside of which the stamping operation runs in a classical manner, between one upper heating plate 320 that is fixed, and a lower plate 330 that is mounted for moving following a vertical back-and-forth movement.

The feeding station for the strip 400 is loaded to assure simultaneous feeding of the machine 1 in the stamping strip 2 and the evacuation of this same strip 2 that has been used one time after being passed to the stamping station 300.

The process of treating the sheets in the stamping machine 1 is completed in the reception station 500, whose principal function is to repackage the sheets that have already been treated into a pile. To do this, the transport device 600 is for example constructed in a way to automatically release each sheet when this sheet is found on the right of this new pile. The sheet otherwise would fall at right angles on the top of the pile.

In a very classical manner, the transport device 600 sets up a series of pincer bars that are mounted to be mobile using two series of chain 620 placed laterally on each side of the stamping machine 1. Each chain series 620 runs through a loop that allows the pincer bars to follow a trajectory passing successively through the stamping station 300, the strip feeding station 400, and the reception station 500.

The ensemble of the pincer bars will leave from a stopped position, accelerate, reach maximum speed, decelerate, then stop, all the while describing a cycle corresponding to the movement of a sheet from one workstation to the following workstation. The chain series 620 move and stop periodically in a way that during each stop, all the pincer bars holding a sheet are passed from one station to the adjacent downstream workstation. Each station does its work synchronized with this cycle, which is called in total a machine cycle. The workstations start a new job at the beginning of each machine cycle.

The feeding station for the strip 400 comprises at least one device for unrolling a strip 10 that can be accumulated from the stamping strip 2 in a pre-unrolled form downstream from at least one stamping school 3 and can deliver the pre-unrolled strip upon each request from an advancing shaft of the machine 1.

For this, the device for unrolling a strip 10 is interposed between at least one stamping spool 3 and the plate press 310 (FIG. 1).

In addition, as one can better see in particular on FIGS. 2 to 11, the device for unrolling a strip 10 comprises a central drum 11, a satellite roller 14, and a planetary leading device 15.

The central drum 11 is configured to be led in a rotation at a variable advancing speed, unified in its rotation with an axis 16 of the device for unrolling a strip 10. On each machine cycle, the speed of advance piloted by the machine 1 increases and then decreases (one speaks of "advance") and then it stops. This step of advance (advance then stop) is made to have the strip to be stamped 2 coincide with a sheet for placing by stamping the metallic film according to a program pre-defined in the machine 1. The advances may be identical or different between each stop or different between at least two successive and periodic stops.

The satellite roller 14 presents an axis 21 constructed parallel to the axis 16 of the central drum 11. The satellite roller 14 can turn around the central drum 11.

Figure 10:
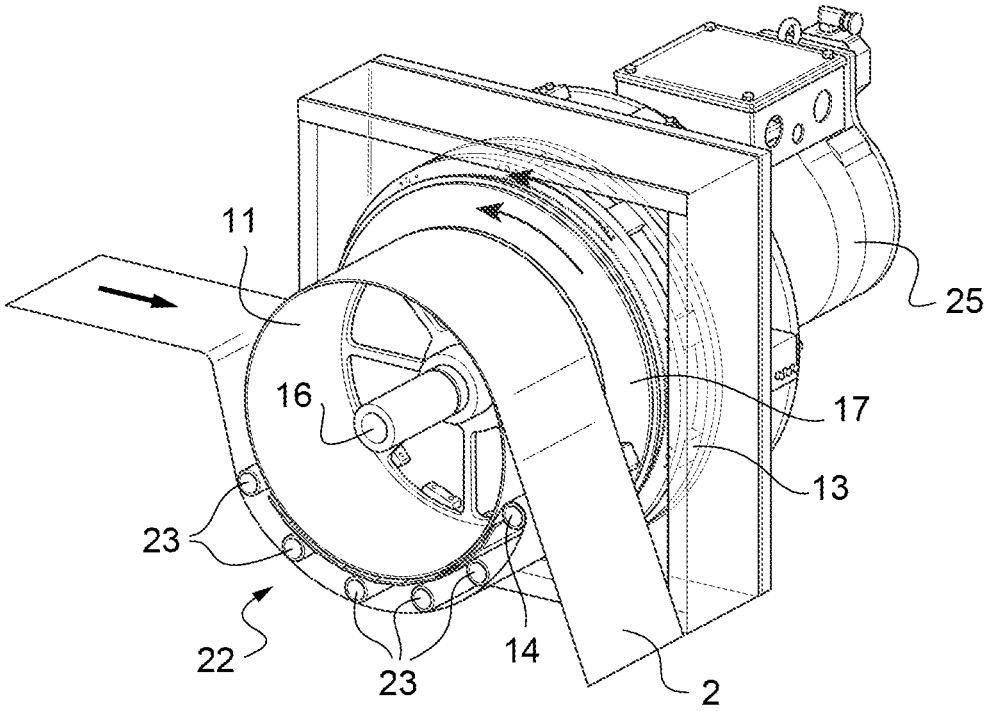
FIG. 10 shows a transverse cut of the device for unrolling a strip of FIG. 2 while unrolling a strip to be stamped, with the device for unrolling the strip being in an extreme first position.
Figure 11:
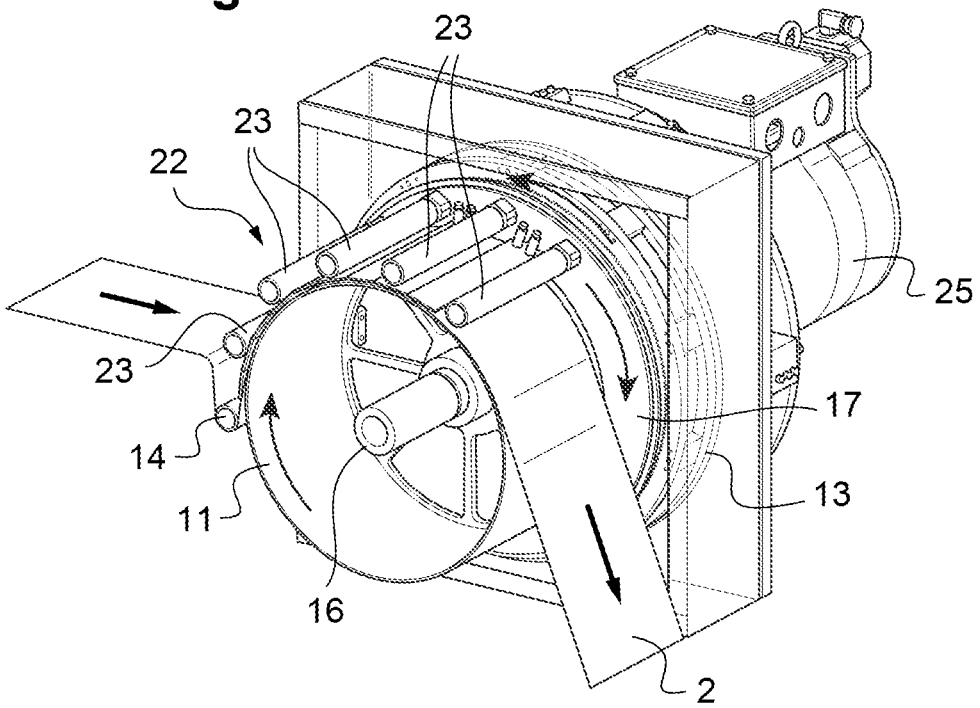
FIG. 11 shows a view similar to that of FIG. 10 in a second extreme position.

While functioning, the pre-unrolled strip can be made to roll around the central drum 11 (for at least one rotation) by the effect of the movement of the satellite roller 14. More precisely, the pre-unrolled strip rolls around the central drum 11 after having gone past the satellite roller 14, forming a lever of the pre-unrolled strip (FIGS. 10 and 11).

Figure 4:
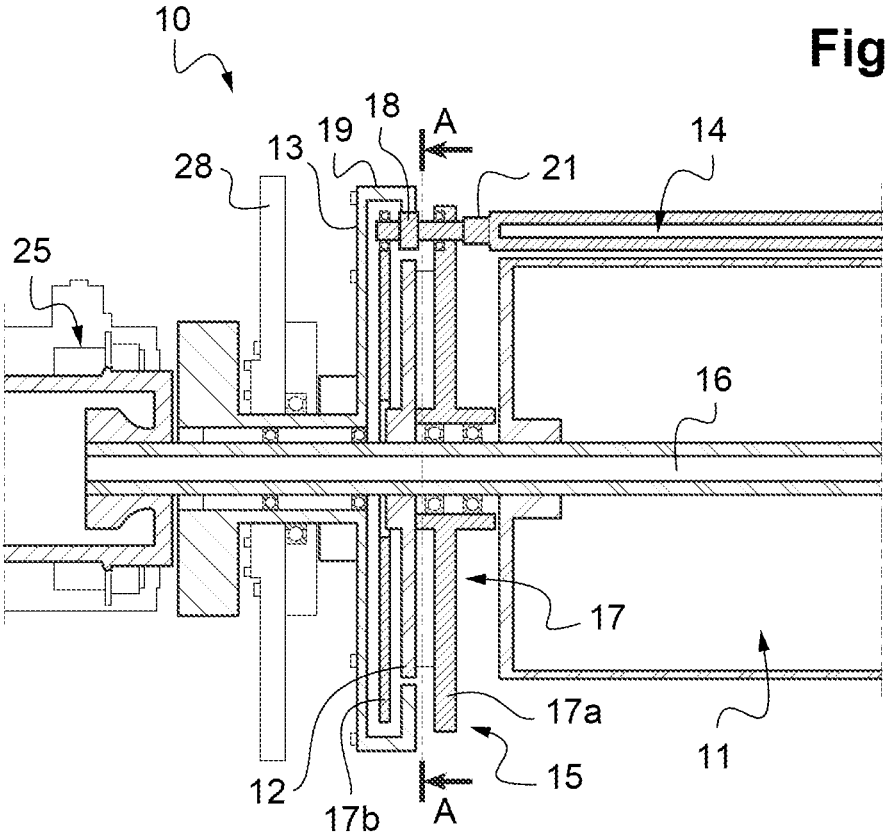
FIG. 4 shows a longitudinal cut of the elements of the device for unrolling a strip of FIG. 2.
Figure 5:
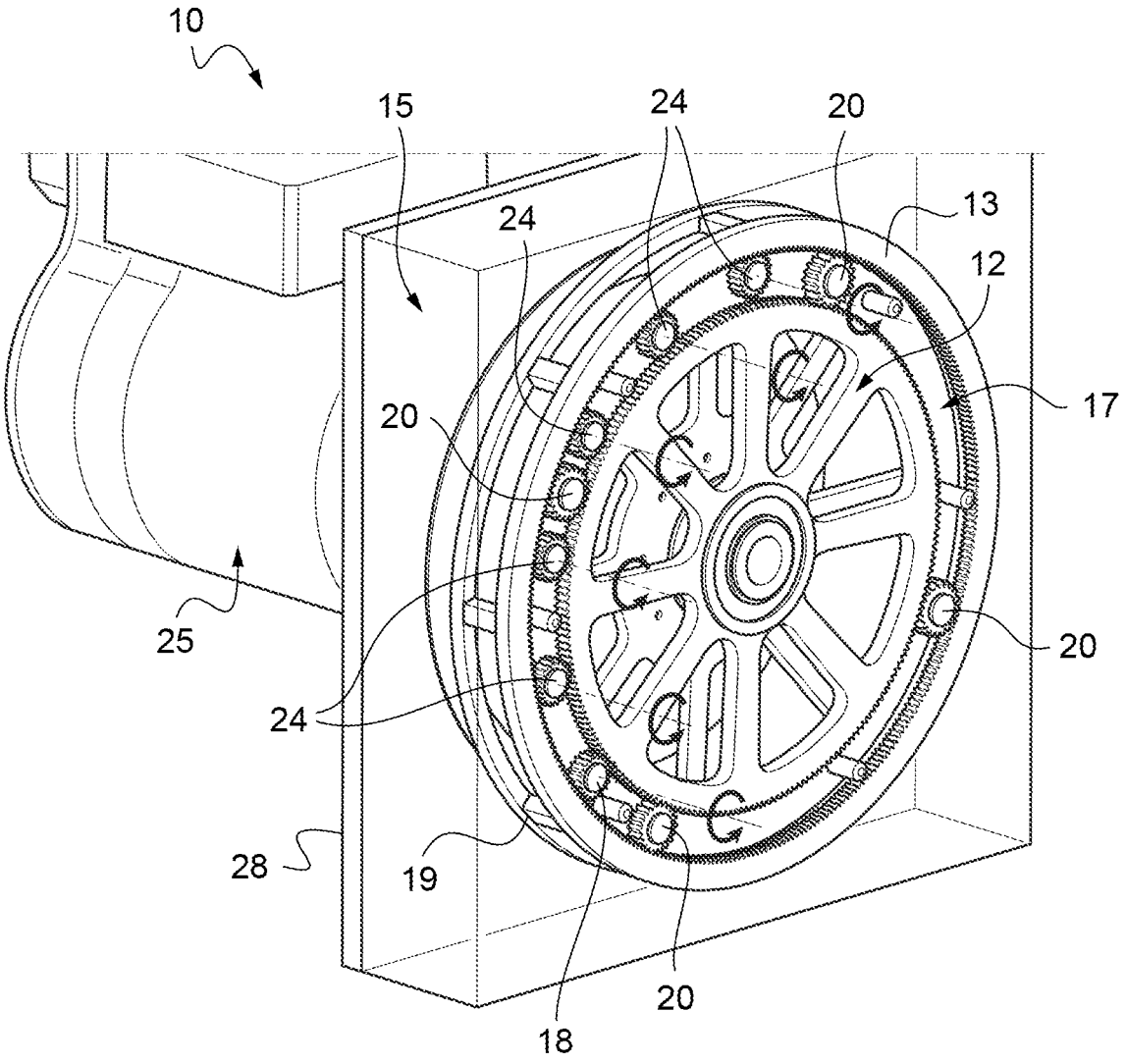
FIG. 5 shows a transverse cut A-A of the elements of the device for unrolling a strip of FIG. 4.

According to one embodiment, the planetary leading device 15 comprises a central cogwheel 12, an exterior ring 13, a satellite door 17, and at least one satellite cogwheel 20 (FIGS. 4 and 5).

Figure 6:
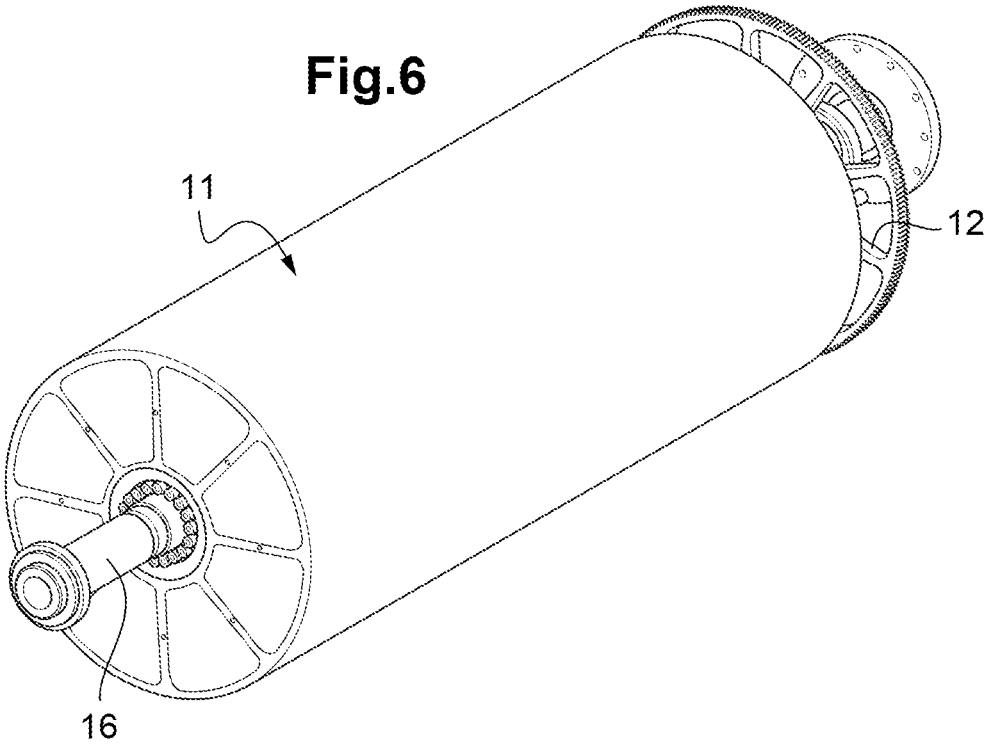
FIG. 6 shows a perspective view of a central drum and a central cogwheel of the device for unrolling a strip of FIG. 2.

The central cogwheel 12 is unified in its rotation with the central drum 11, and it is coaxial to the central drum 11 (FIG. 6). For example, they are fixed to the axis 16 (FIG. 4). For example, a bearing supports the opposite extremity of the axis 16.

For example, the original radius of the central cogwheel 12 corresponds to the exterior radius of the central drum 11 (FIG. 6).

Figure 7:
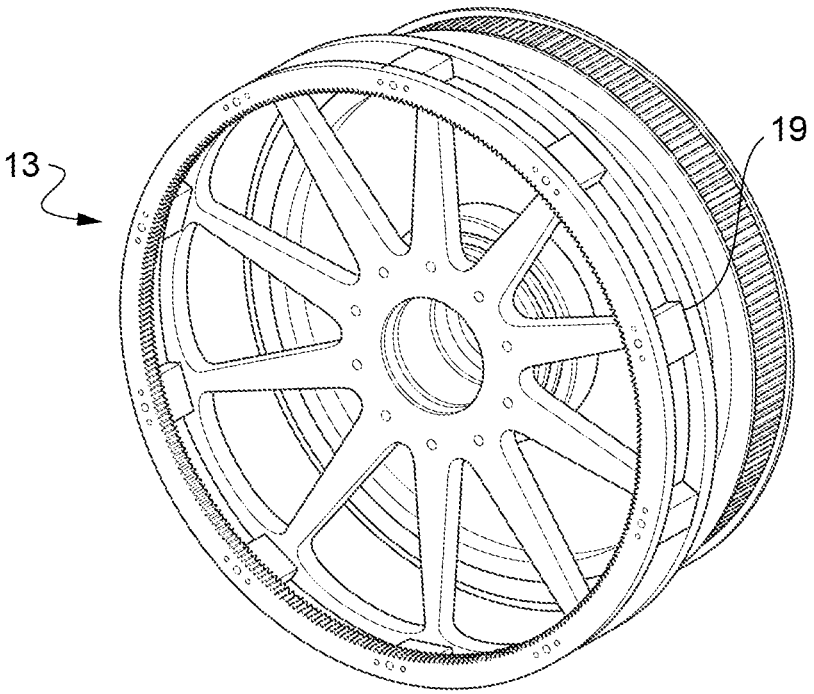
FIG. 7 shows a perspective view of exterior ring and a support of the device for unrolling a strip of FIG. 2.

The exterior ring 13 is toothed (FIG. 7). It is coaxial to the central cogwheel 12 and is configured to be led into rotation at a constant speed. "Constant" means a roughly constant speed, that is to say, for example, varying less than +/−10% of an average speed. The constant speed is for example roughly equal to an average value of the variable advance speed.

The rotation direction of the exterior ring 13 is opposite to the rotation direction of the central drum 11. The rotation direction of the exterior ring 13 is chosen so that the rotation of the exterior ring 13 unrolls the stamping spool 3.

For example, the exterior ring 13 is carried by a support 19 mounted in rotation on the axis 16 by means of a bearing (FIG. 4). In the axial direction, the central cogwheel 12 is interposed between the central drum 11 and the support 19 of the exterior ring 13.

The satellite roller 14 for example presents a diameter smaller in size than the radial gap located between the original diameter of the exterior ring 13 and the exterior diameter of the central drum 11, which allows an interior strand of the strip to be stamped 2 being rolled on the central drum 11 to be interposed without being jammed between the satellite roller 14 and the central drum 11.

The satellite door 17 is united in movement with the satellite roller 14 around the central drum 11 and coaxial to the central drum 11. The satellite door 17 is for example mounted in rotation on the axis 16 by means of a bearing (FIG. 4).

Figure 8:
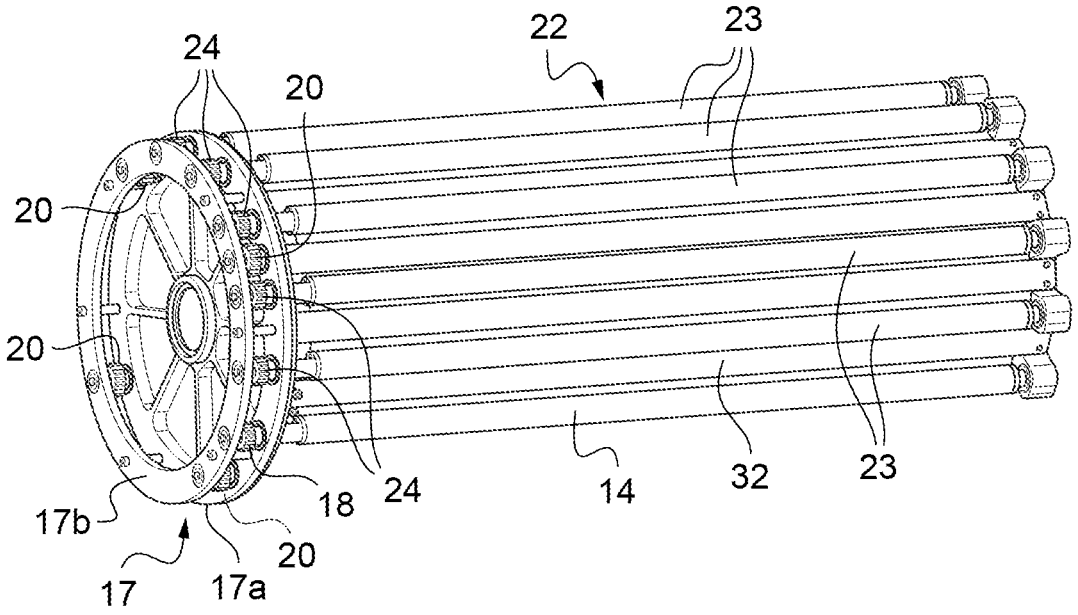
FIG. 8 shows a perspective view of a planetary leading device of the device for unrolling a strip of FIG. 2.
Figure 9:
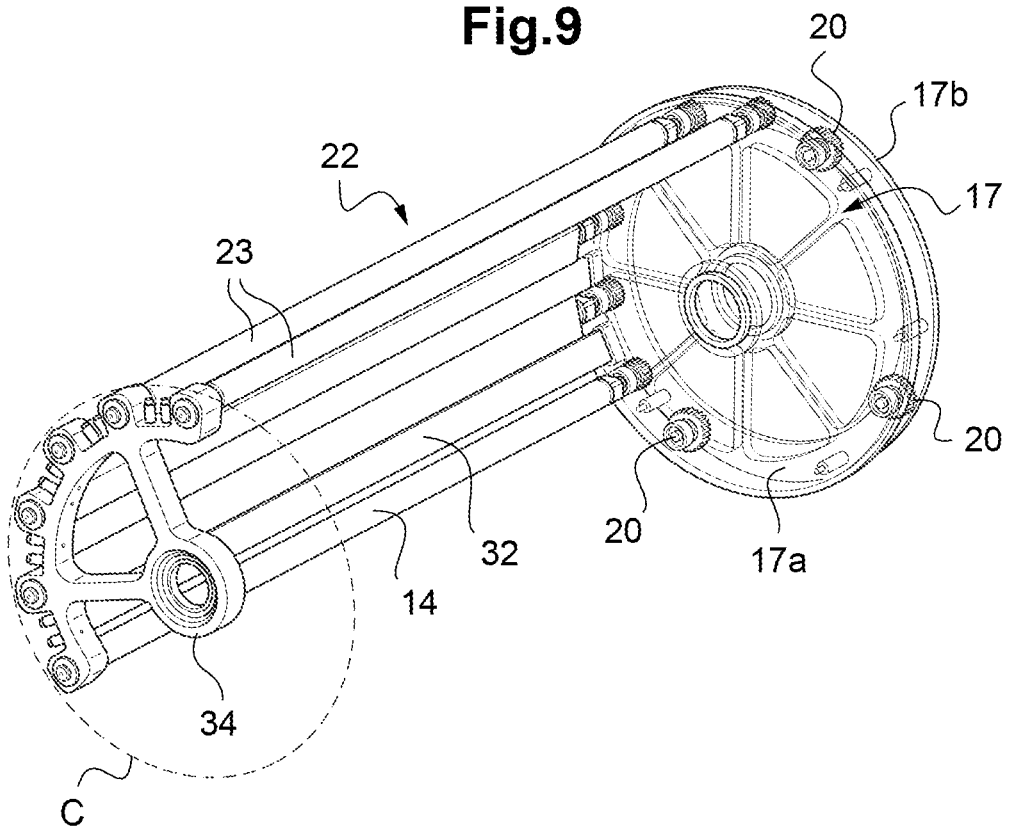
FIG. 9 shows another view of the planetary leading device of FIG. 8.

As an example, the satellite door 17 is formed on the one hand by a disk 17*a*, for example a solid one, presenting a bearing at the center, and on the other hand by a ring 17*b* fixed coaxially to the disk 17*a* and supporting flat bearings for the axes of the at least one satellite cogwheel 20, and as applicable and as one will see later, of the toothed wheels 18 and 24 (FIGS. 4, 8, and 9).

The at least one satellite cogwheel 20 is mounted on the satellite door 17. It engages on one hand the exterior ring 13 and on the other the central cogwheel 12 to be led in rotation in one direction or the other of the central drum 11 as a function of the difference of rotation speeds of the central drum 11 and the exterior ring 13. The movement of the at least one satellite cogwheel 20 leads the movement of the satellite bearing 14 around the central drum 11, which causes variation in the length of the pre-unrolled strip.

The planetary leading device 15 comprises for example four satellite cogwheels 20 mounted on the satellite door 17, for example described in the form of a cross (FIGS. 5, 8, and 9).

The satellite cogwheels 20 transmit the leading of the exterior ring 13 and of the central cogwheel 12 to the satellite door 17, united in its movement with the satellite bearing 14. The satellite cogwheels 20 are not themselves connected to any satellite bearing.

The diameter of the at least one satellite cogwheel 20 is for example roughly larger than the diameter of the satellite bearing 14.

The satellite cogwheels 20, the central cogwheel 12, and the exterior ring 13 are constructed at one extremity of the axis 16, roughly on the same plane. They are for example received into a box 28 (FIGS. 2 and 3). This construction of the engaged items is also called "epicycloid train" or "planetary leading", with the "planetary interior" or "sun" being the central cogwheel 12, and the "planetary exterior" or "ring" being the exterior ring 13 and the "satellite" engaging the two planetaries and turning around their common axis being the satellite cogwheel 20, the "common axis" being the axis 16.

According to one embodiment, the satellite bearing 14 is rotating, and may turn on itself around its axis 21. The stamping strip 2 may thus roll without rubbing around the satellite bearing 14.

According to one embodiment, the planetary leading device 15 consists in addition of a toothed wheel 18 mounted on the satellite door 17, united in movement with the satellite roller 14 and engaging the exterior ring 13. The toothed wheel 18 and the satellite bearing 14 are for example mounted on the axis 21 at one end of the satellite bearing 14 (FIG. 4). A flat bearing area supports for example the opposite extremity of the axis 21 of the satellite bearing 14. The original radius of the toothed wheel 18 corresponds for example to the exterior radius of the satellite bearing 14. The speed of circumferential rotation of the satellite bearing 14 thus corresponds to the rotation speed of the exterior ring 13 to which the strip to be stamped 2 is unrolled from the stamping spool 3. The strip to be stamped 2 may thus be led by the satellite bearing 14 at the same speed as the unwinding from the stamping spool 3.

According to another embodiment, the satellite roller 14 is non-rotating. it is for example fixed to the satellite door 17. In this case, the satellite roller 14 may be porous, and present an internal cavity configured to be placed in communication with the pressurized air in a way to form a cushion of air under the strip to be stamped 2 so that the strip to be stamped 2 can roll around the satellite roller 14 without rubbing.

According to one embodiment, the planetary leading device 15 comprises in addition a guide 22 united in movement with the satellite roller 14 around the central drum 11 (FIGS. 8 and 9).

The guide 22 can be interposed between two strands of the pre-unrolled strip 2, with an interior strand of the strip to be stamped 2 being against the central drum 11, and an exterior strand to guide an exterior strand of the strip (FIGS. 10 and 11).

According to one embodiment, the guide 22 comprises between one and ten, such as five, additional satellite rollers 23, with the additional satellite roller or rollers 23 and the satellite roller 14 describing a circle C (FIG. 9). The additional satellite rollers 23 and the satellite roller 14 are for example regularly spaced, for example on an arc of a circle inclusive between 90° and 180°. The guide 22 may also comprise a maintenance element 34 to maintain and guide the opposing extremities of the additional satellite rollers 23 around the axis 16.

The additional satellite roller or rollers 23 may be rotating. The exterior strand of the pre-unrolled strip may thus slide over the additional rotating satellite rollers 23 practically without rubbing.

On the example of FIGS. 1 to 11, the guide 22 comprises between one and ten, such as five, additional rotating satellite rollers 23 and as many toothed wheels 24 mounted on the satellite door 17 (FIGS. 5 and 8). The toothed wheels 24 are united in their rotation with their respective additional satellite roller 23. They are mounted at an axial extremity of an additional satellite roller 23 respectively and engage the exterior ring 13. A flat bearing area may support the opposed extremity of each additional satellite roller 23.

The additional satellite rollers 23 and the toothed wheels 24 present for example diameters with dimensions similar to that of the satellite roller 14. The interior strand of the strip to be stamped 2 may also be interposed without jamming between on the one hand the satellite roller 14 and the additional satellite rollers 23, and on the other hand, the central drum 11.

The diameter of the said circle C of the exterior ring 13 corresponds roughly to the original diameter of the exterior ring 13. The speed of circumferential rotation of the additional satellite rollers 23 corresponds to the speed of rotation of the exterior ring 13 to which the strip to be stamped 2 is unrolled from the stamping spool 3. The strip to be stamped 2 may thus be led by the additional satellite rollers 23 at the same speed as it is unwound from the stamping spool 3.

The strip to be stamped 2 coming from the stamping spool 3 may thus be guided by the additional satellite rollers 23 in a way that the exterior strand follows approximately the original diameter of the exterior ring 13, with the exterior strand being roughly parallel to the interior strand of the strip that rolls around the central drum 11. In addition, there are additional satellite rollers 23, and the guidance of the exterior strand is close to a circle, something that permits avoiding fits and starts in unrolling the strip.

The guide 22 may also comprise a plate 32, or elements of a plate, fixed to the satellite door 17 in an arc of a circle in order to guide the interior strand of the strip to be stamped 2 against the central drum 11 (FIGS. 8 to 11).

Between the stamping spool 3 and the device for unrolling a strip 10, the strip to be stamped 2 is for example oriented tangential to the additional satellite rollers 23 by entry lever 26. In leaving the device for unrolling a strip 10, the strip to be stamped 2 may be levered to horizontal position by an exit lever 27 in order to guide the strip 2 to a plane in the plate press 310 (FIG. 1).

According to one embodiment, it is planned that the device for unrolling a strip 10 comprises a motor 25 configured to lead the axis 16 of the central drum 11 to a variable speed of advance (FIGS. 3 and 4). The motor 25 is for example in a direct connection with the extremity of the axis 16. The axis 16, united in rotation with the central drum 11 to unroll the strip to be stamped 2, thus also forms the advancing shaft. The number of parts can thus be reduced.

The device for unrolling a strip 10 may also comprise a roller for advance 29 pressing against the central drum 11 to guarantee good transmission between the strip to be stamped 2 and the central drum 11 (FIG. 1).

The exterior ring 13 may be led in rotation at a constant speed by a supplementary motor 31 of the device for unrolling a strip 10 (FIG. 3). The supplementary motor 31 leads the exterior ring 13 for example by a system of pulleys.

In functioning, the exterior ring 13 is led in rotation at a constant speed, for example at a rotation speed roughly equal to the average value of the variable advance speed (in a counter clockwise direction in the example of FIGS. 10 and 11).

When the speed of advance is zero (FIG. 10), the satellite roller 14 is led (here in the counter clockwise rotation direction) around the central drum 11 by the exterior ring 13. The movement of the satellite roller 14 has the effect of increasing the length of the pre-unrolled strip and thus the reserve amount of strip that is accumulated. FIG. 10 thus illustrates a first extreme position of the satellite roller 14 for which the reserve of the pre-unrolled strip is at a maximum. While the satellite roller 14 moves around the central drum 11 to reach this first extreme position, the placement of the gilded or metallic film is accomplished on a sheet in the plate press 310.

Then, when the advance speed increases (FIG. 11), the central drum 11 is led into rotation in the direction contrary to that of the exterior ring 13 (in the clockwise direction on FIG. 11) leading the rotation of the satellite roller 14 in the same direction, which reduces the length of the pre-unrolled strip that is delivered to the stamping station 400. FIG. 11 shows an example of a second extreme position of the satellite roller 14 for which the reserve of the pre-unrolled strip is at a minimum.

Then the advance speed declines until stopping. Consequently, the satellite roller 14 is led (here in the counter clockwise direction) around the central drum 11 by the exterior ring 13 until the point where it comes back to its first extreme position (FIG. 10). A new machine cycle then starts up and follows.

The strip to be stamped 2 may then be pre-unrolled at the constant speed of the stamping spool 3, drawn by the satellite roller 14. The strip may be delivered when leaving the device for unrolling a strip 10 at the variable advance speed given by the central drum 11. The accumulated length of the script to be stamped 2 varies according to the angular movement of the satellite roller 14 around the central drum 11, which varies around it, due to the planetary leading, as a function of the difference of the rotation speeds of the central drum 11 and the exterior ring 13. It is thus possible to accumulate the strip to be stamped 2, and then to deliver the accumulated strip to be stamped 2 upon each request from the leading shaft.

Several spools 3 may also be unrolled with the device for unrolling a strip 10 if these are delivered to the stamping station 300 with the same advance speed.

It is understood that the device for unrolling a strip 10 is more compact than a "linear" system of the previous state-of-the-art because it can be integrated directly into the machine 1. It is also more robust and easier to set in motion. The distance between the spool 3 and the press 310 may be small, which permits an increase in the precision of the placement of the strip and thus allows a reduction in the amount of the strip consumed. The unrolling of the stamping spool 3 may continue to be braked during production by a braking device in order to guarantee tension of the minimum strip in a much gentler manner, something that permits avoiding the fits and starts that may cause the strip to deteriorate.

Figure 12:
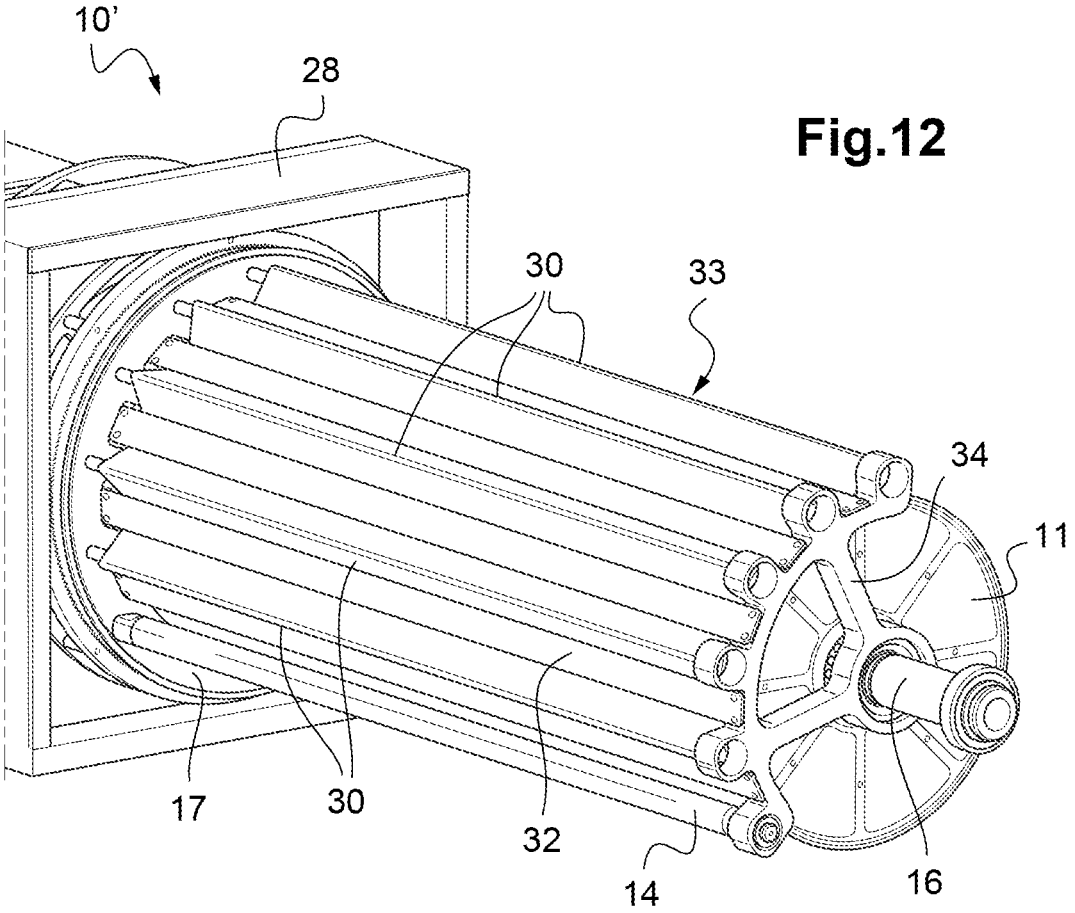
FIG. 12 shows a perspective view of the elements of a device for unrolling a strip according to a second embodiment.

FIG. 12 illustrates another embodiment of the device for unrolling a strip 10'.

This example differs from the prior one by the fact that here the guide 33 comprises a metallic element, such as a metallic sheet or such as a piece of sheet metal, presenting between one and ten, for example five, folds or curves 30.

An axial extremity of the metallic element is fixed to the satellite door 17. The guide 33 may also comprise a maintenance element 34 to maintain and guide the opposite extremity of the metallic element around the axis 16.

The folds or curves 30 and the satellite roller 14 (in the radial direction like axis 16) describe a circle, coaxial to the exterior ring 13. The diameter of the said circle corresponds for example roughly to the original diameter of the exterior ring 13.

The folds or curves 30 are for example regularly spaced, for example on a circle of an arc included between 90° and 180°.

The exterior strand of the pre-unrolled strip may also slide over the folds or curves 30 practically without rubbing. The strip to be stamped 2 coming from the stamping spool 3 may thus be guided by the folds and curves 30 in a way that the exterior strand follows approximately the original diameter of the exterior ring 13, with the exterior strand being roughly parallel to the interior strand of the strip that rolls around the central drum 11. The more folds or curves 30, the more guidance of the exterior strand is close to a circle, something that permits avoiding fits and starts in unrolling the strip.

The invention claimed is:

1. A device for unrolling a strip for a stamping machine that allows an accumulation of the strip to be stamped under a pre-unrolled form between at least one stamping spool and a plate press of the stamping machine, the device comprising:

a central drum configured to be led in rotation at a variable advance speed, connected in rotation with an axis of the device for unrolling the strip, a satellite roller presenting an axis constructed parallel to the axis of the central drum, wherein the satellite roller can be turned around the central drum, and the pre-unrolled strip is rolled around the central drum due to movement of the satellite roller, and a planetary leading device to move the satellite roller around the central drum as a function of a difference of rotation speeds of the central drum and of an exterior ring of the planetary leading device, the planetary leading device being configured to be led in rotation at a constant speed in a first rotation direction contrary to a second rotation direction of the central drum.

2. The device of claim 1, wherein the planetary leading device includes:

a central cogwheel in rotation around and coaxial to the central drum, while the exterior ring is coaxial to the central cogwheel, a satellite door united with the movement of the satellite roller around the central drum and coaxial to the central drum, and at least one satellite cogwheel mounted on the satellite door, the at least one satellite cogwheel engaging the exterior ring and the central cogwheel to be led in rotation in the first direction or the second direction around the central drum as a function of the difference of the rotation speeds of the central drum and the exterior ring.

3. The device of claim 2, wherein an original radius of the central cogwheel corresponds to an exterior radius of the central drum.

4. The device of claim 3, wherein a diameter of the satellite roller has a dimension less than a radial space situated between the original diameter of the exterior ring and the exterior diameter of the central drum.

5. The device of claim 4, wherein the satellite roller rotates.

6. The device of claim 5, wherein the planetary leading device includes a toothed wheel mounted on the satellite door, the toothed wheel being united in movement with the satellite roller and engaging the exterior ring.

7. The device of claim 6, wherein an original radius of the toothed wheel corresponds to an exterior radius of the satellite roller.

8. The device of claim 1, wherein the satellite roller is fixed on a satellite door of the planetary leading device, and the satellite roller is porous, presenting an internal cavity configured to communicate with pressurized air so as to form a cushion of air under the strip to be stamped.

9. The device of claim 1, wherein the planetary leading device includes a guide united in movement with the satellite roller around the central drum, the guide being susceptible to be interposed between two strands of the pre-unrolled strip to guide an exterior strand of the said strip.

10. The device of claim 9, wherein the guide includes one to ten additional satellite rollers, the one to ten additional satellite rollers and the satellite roller describing a circle.

11. The device of claim 10, wherein the one to ten additional satellite rollers rotate.

12. The device of claim 11, wherein the guide includes corresponding toothed wheels to the one to ten additional satellite rollers, the corresponding toothed wheels being mounted on the satellite door and united in rotation with a respective additional satellite roller of the one to ten additional satellite rollers and engaging the exterior ring.

13. The device of claim 10, wherein a diameter of the circle corresponds to an original diameter of the exterior ring.

14. The device of claim 9, wherein the guide includes a metallic element fixed to the satellite door presenting one to ten folds or curves, the one to ten folds or curves and the satellite roller describing a circle.

15. The device of claim 1, wherein the exterior ring is configured to be led in rotation at a constant speed roughly equal to an average value of a variable advance speed.

16. The device of claim 1, wherein the axis of the central drum can be led in rotation to a variable advance speed by a motor of the device to form a leading shaft.

17. A stamping machine of elements in a form of sheets configured to place on each sheet gilded or metallic film that is created of at least one strip to be stamped, the stamping machine comprising: at least one device for unrolling a strip as claimed in claim 1.

* * * * *